US006523371B1

(12) United States Patent
Sherratt et al.

(10) Patent No.: US 6,523,371 B1
(45) Date of Patent: Feb. 25, 2003

(54) DEVICE FOR MACHINE WASHING OF CLOTHES

(75) Inventors: Paul Robertson Sherratt, Sao Paulo (BR); Mark Shickle, Richmond (GB)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/397,982

(22) Filed: Sep. 16, 1999

(30) Foreign Application Priority Data

Sep. 18, 1998 (GB) ..... 9820466

(51) Int. Cl.[7] ..... D06F 39/02
(52) U.S. Cl. ..... 68/17 R; 68/235 R; 510/439
(58) Field of Search ..... 68/17 R, 235 R; 206/5; 510/297, 439

(56) References Cited

U.S. PATENT DOCUMENTS 4,567,675 A * 2/1986 Rennie ..... 206/0.5 X
4,969,927 A 11/1990 Schumann et al.

FOREIGN PATENT DOCUMENTS

| | | |
|---|---|---|
| EP | 343 070 | 11/1989 |
| GB | 2 263 484 | 6/1992 |
| GB | 2 317 378 | 3/1998 |
| WO | 95/04682 | 2/1995 |
| WO | 97/06301 | 2/1997 |

* cited by examiner

*Primary Examiner*—Philip Coe
(74) *Attorney, Agent, or Firm*—Gerard J. McGowan

(57) ABSTRACT

A dispensing device for the machine washing of laundry comprises a receptacle for receiving an amount of detergent product having filling opening means and a body wall which includes a plurality of apertures for dispensing detergent product. The device includes a rigids spacing means which is formed around the body wall for spacing laundry from the dispensing apertures.

11 Claims, 8 Drawing Sheets

Fig.1.
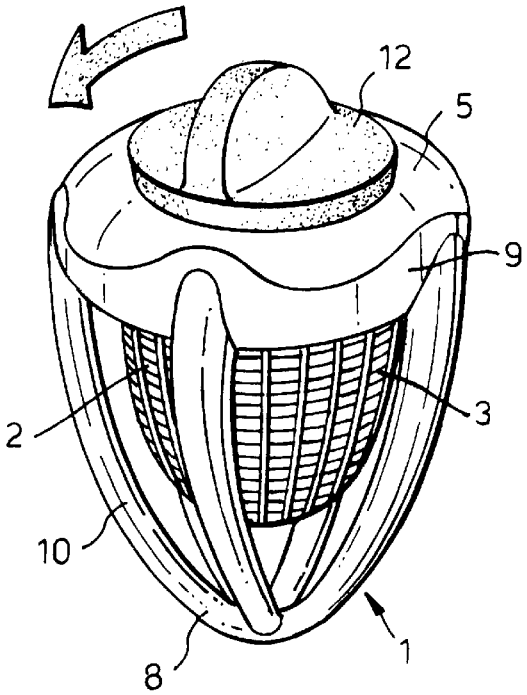
Fig.3.
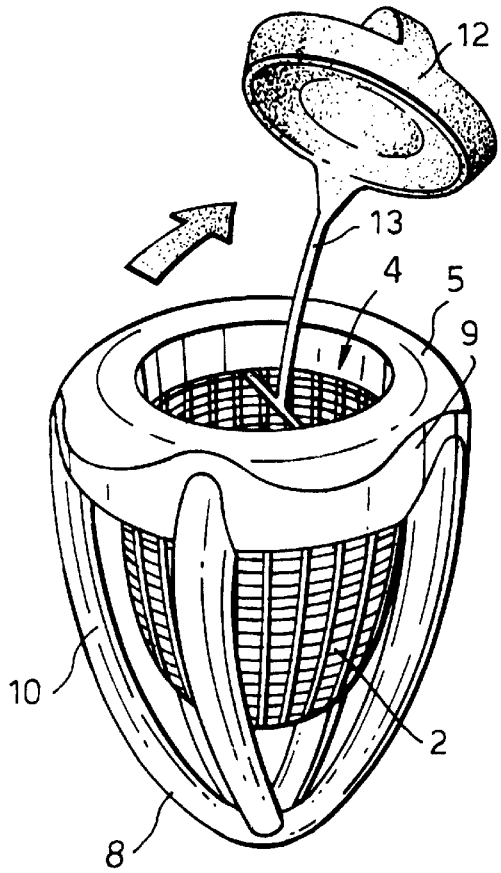
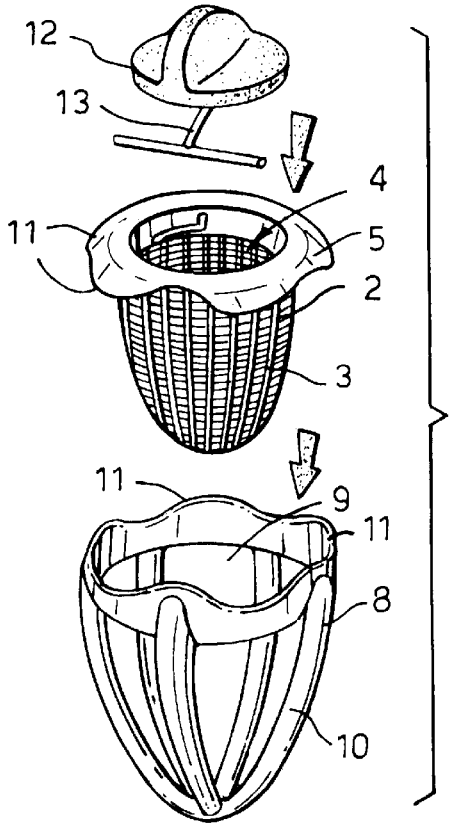
Fig.2.

Fig.6.
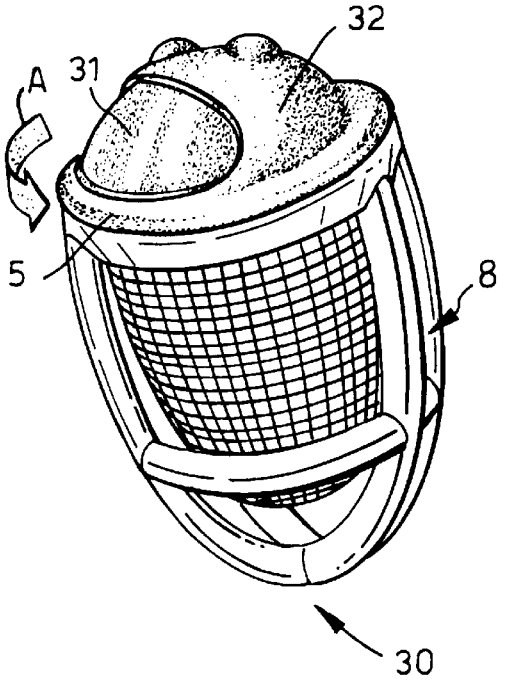
Fig.7.
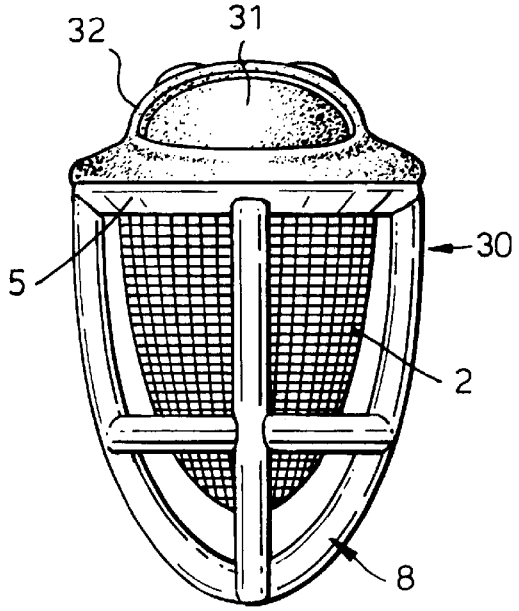
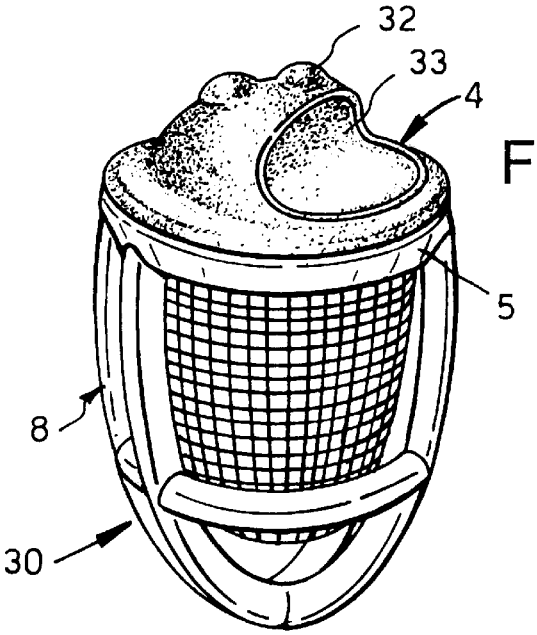
Fig.8.

DEVICE FOR MACHINE WASHING OF CLOTHES

INTRODUCTION

The invention relates to a dispensing device for the machine washing of laundry.

Various forms of detergent dispensing devices have been proposed for machine washing of laundry. For example, EP 0 343 070 describes a device comprising a water permeable bag having a mouth retained in an open position by a rigid annular rim. In use detergent powder is scooped into the bag and the filled device is put into the machine with the clothes. During the wash cycle, wash liquor penetrates the bag through both the open mouth and the walls of the bag to dissolve and disperse the powder contained within the bag. A problem encountered with this device is that during use the mouth of the device tends to get plugged up by the laundry. In order to solve this problem WO 95/04682 proposed the provision of a rigid spacing means projecting over a plane of the mouth to keep laundry away from a mouth of the bag thus preventing a mouth of the bag becoming blocked. While this solution has improved the operation of the device by improving the throughput of water and detergent through the mouth, the solution does not address the perceived problem of getting solution in and out of the bag through the water permeable walls of the bag. With recent washing operations moving towards the usage of less water, this perceived problem has increased.

It is an object of the invention to solve at least some of the above problems.

STATEMENTS OF INVENTION

These objects are broadly achieved in the provision of a dispensing device for the machine washing of laundry comprising a receptacle for receiving an amount of a detergent product, the receptacle including a body wall having filling opening means and a plurality of apertures for dispensing the detergent product, wherein the device includes a rigid spacing means, preferably is formed around the body wall, for spacing laundry from the dispensing apertures. A device formed in accordance with the invention provides a space between the body wall of the receptacle and the fabric within which space wash liquor may freely circulate to better access the apertures in the body wall. The result of this better circulation of water is that the detergent product within the receptacle is exposed to greater amounts of water and as such is more quickly, and indeed more thoroughly, dissolved or otherwise exposed to wash liquor. Furthermore, the spacing keeps a distance between the bulk of the detergent and the laundry hence reducing incidence of damage to the laundry due to direct contact between the laundry and the detergent product.

Typically, the receptacle may be in the form of a perforated body which is ideally substantially rigid. Such bodies may be formed by means of injection molding and may have perforations which are dimensioned to allow the penetration of water into the receptacle while preventing the detergent product in its initial form from passing out of the device through the perforations. Thus when the detergent is a particulate powder, the perforations will be of relatively small dimension, and certainly less than the dimension of the grain size of the detergent. Typical sizes of such perforations would be in the region of between 1 and 1000 microns. However, other sizes are envisaged depending on the grain size of the detergent product, or depending on the viscosity of the liquid when the detergent product is a liquid. Alternatively, when a larger form of detergent is employed such as, for example, a detergent tablet, the perforations in the body may be larger and less profuse. In a particularly preferred embodiment of the invention the receptacle comprises a body formed of a mesh type structure.

Alternatively, the receptacle is in the form of a flexible bag or sheath, the component material of the receptacle being water permeable.

In one embodiment of the invention, the filling opening means of the receptacle is defined by a peripheral rim, which ideally supports the spacing means which extends around the body wall of the receptacle. Thus, for example, when the peripheral rim is annular, the spacing means may comprise at least one arcuate element which extends from one point on the peripheral rim, around the body wall, to a second point on the peripheral rim. Generally, the device will include a plurality of such elements, ideally two, the number, shape and orientation of the elements depends on the size and shape of the receptacle.

In another embodiment of the invention the device is provided in two interconnecting parts, a first part comprising the spacing means which is generally in the form of a cage having an open mouth, and a second part comprising the receptacle whose filling opening is ideally defined by a peripheral rim. The two parts are interconnected by inserting the receptacle into a mouth of the cage, the receptacle being preferably constrained in position by virtue of the peripheral rim engaging with the cage, ideally with a mouth of the cage. Typically the engagement will be of a snap-fit type, however any other type of engagement means is envisaged.

The filling opening means of the device may take many forms. For example, when the opening is defined by a mouth or mouthpiece or peripheral rim, the opening may be closed using suitable closure means. Ideally, the closure comprises a plug means which typically will include anchor means to allow the plug be removed from the opening without the plug being detached from the device. In another embodiment of the invention, the closure means comprises a two part assembly comprising a first part fixedly mounted to the rim of the opening, which part includes a filling opening, and a second part having a filling opening rotatably mounted relative to the first part, such that in one orientation of the two parts the two filling openings overlap to reveal a filling opening.

In an alternative embodiment of the invention, the receptacle is formed by two parts which engage to form a closed receptacle. Typically the two parts will be hingedly connected. Thus the receptacle is preferably an essentially hollow round body having two, ideally symmetrically, opposed parts, optionally connected by a hinge, the parts being movable together and apart about the hinge to provide a filling opening. Preferably, abutting portions of each part are provided in the form of generally rigid rim potions, wherein the spacing means extends from each rim portion to extend around the receptacle part. In this manner the spacing means may take the specific form of the spacing means described above.

The device according to the invention is envisage to be used with all forms of detergent product, both solid and liquid. The solid detergents envisaged would include powders, granules, flakes, pellets, tablets and the like. When liquids are used it is important that the dispensing apertures in the receptacle are of a dimension such as to allow ingress of wash liquor while preventing the liquid detergent in a substantially undiluted state from passing out of the receptacle through the apertures.

The invention also provides a process for washing laundry in a machine employing a device according to the invention, the process comprising the steps of:

adding an amount of a detergent product to the device through the filling opening means;

placing the device in a washing machine with laundry;

carrying out a washing operation; and recovering the device after the washing operation.

Preferably the process includes an intermediate step of closing the filling opening means prior to placing the device in the machine.

The invention also provides the combination of a dispensing device according to the invention with a detergent product.

The invention will be more clearly understood from the following description of some embodiments thereof, given by way of example only, with reference to the accompanying drawings in which:

FIGS. 1 to 3 are perspective views of a dispensing device according to the invention, with FIG. 2 showing an exploded view if the device;

FIG. 6 is a perspective view of a dispensing device according to an alternative embodiment of the invention;

FIG. 7 is a front elevational view of the device of FIG. 6;

FIG. 8 is a perspective view of the device of FIGS. 6 and 7 in an open orientation;

DETAILED DESCRIPTION OF THE INVENTION

Figure 5:
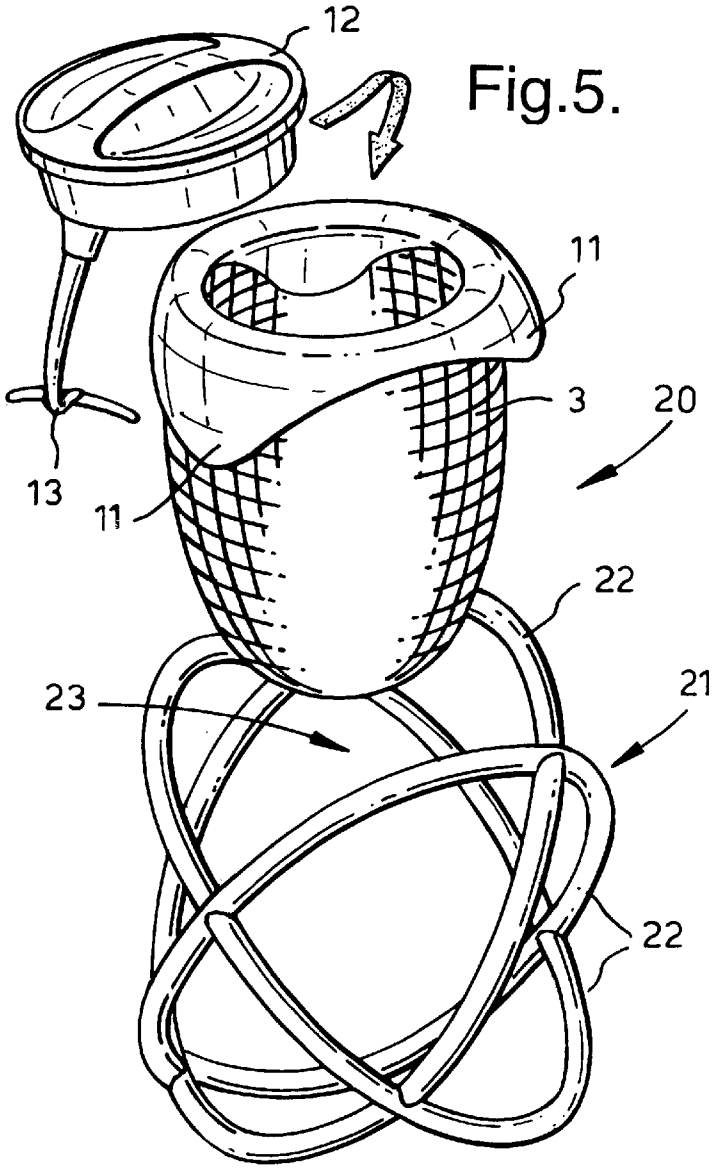
FIG. 5 is an exploded view of the device of FIG. 4.

Referring to the drawings, and initially to FIGS. 1 to 3, there is illustrated a dispensing device according to the invention, indicated generally by the reference numeral 1, and comprising a receptacle 2 for receiving an amount of a detergent product, the receptacle 2 including a body wall 3 and a filling opening 4 defined by a rigid peripheral rim 5. The body wall, which in this instance comprises a water permeable mesh of substantially rigid construction includes apertures having an average dimension of 0.8 mm which, while allowing water and wash liquor to freely transverse the body wall 3, prevents the detergent product, in this instance a particulate detergent powder, from traversing the body wall 3. The device 1 includes a rigid spacing means in the form of a resilient cage 8 having a mouthpiece 9 and arcuate spacing elements 10, each of which extends from a first point on the mouthpiece 9 to a second point on the mouthpiece diametrically opposed to the first point. The mouthpiece 9 of the cage 8 and the rim of the receptacle 2 include mutually engagable formations 11 which allow the cage 8 and the receptacle 2 engage in an snap-fit manner. The device further includes a plug 12 for closing the filling opening 4, the plug 12 being dimensioned for a tight fit within the opening 4, and including an anchoring stalk 13 which allows the plug 12 to be removed from the filling opening 4 while remaining attached to the device 1.

The receptacle 2 is ideally formed by means of injection molding and comprises a plastic material. The cage 8, plug 12 and rim 5 of the receptacle 2 are suitably formed likewise by injection molding, and comprise a plastic or polymeric material which while quite resilient is sufficiently soft to substantially prevent the device making any noise when in use in a machine. The cage 9, receptacle 2 and plug 12 are generally formed in three separate injection molding processes and thereafter assembled, however it is envisaged that all three may be made and assembled in a single process.

In use, the assembles device 1 as shown in FIG. 3 is filled with a desired amount of detergent product through the filling opening 4, whereupon the closing plug 12 is pressed into the filling opening 4 and tightened to effectively close the opening 4. The plug 12 in this instance includes a detent 15 on its circumferential surface which, on engagement with the receptacle rim 5, engages a slot 16 on the rim 5. Twisting of the plug 12 locks the plug 12 in the opening 4. The device 1 is then placed in a washing machine with laundry to be washed, and a washing operation is carried out in abnormal manner. During the wash the wash water will be able to freely circulate between the cage 9 and the body wall of the receptacle 2, thus providing for better access of the water to the apertures in the body wall, and thus better, faster and more efficient dissolution of the product contained therein. Further, the fact that the cage spaces the laundry from the body wall substantially prevents concentrated detergent solution, slurry or paste coming into direct contact with the laundry, instead the concentrated form of the detergent being dissolved or diluted by the aqueous wash liquor passing between the cage 8 and the receptacle 2. On completion of the washing programme, the device 1 is removed from the machine for further use.

Figure 4:
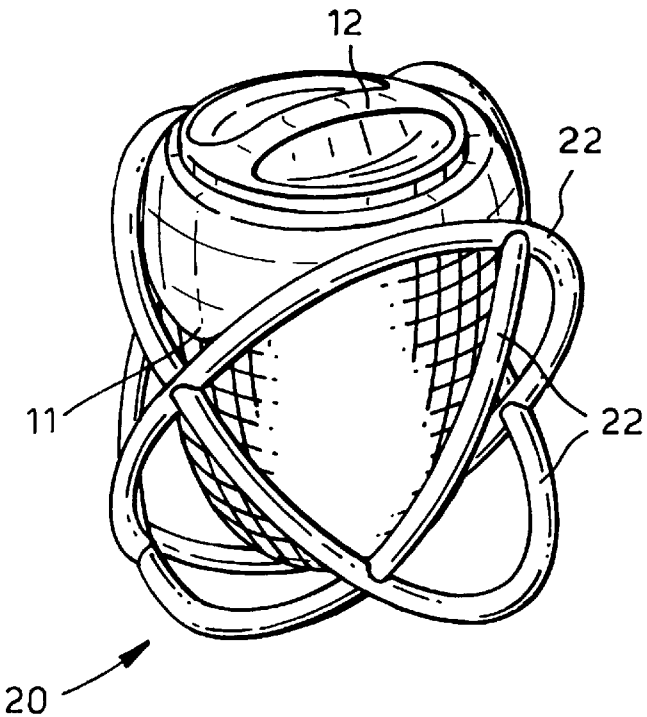
FIG. 4 is a perspective view of a device according to an alternative embodiment of the invention.
Figure 9:
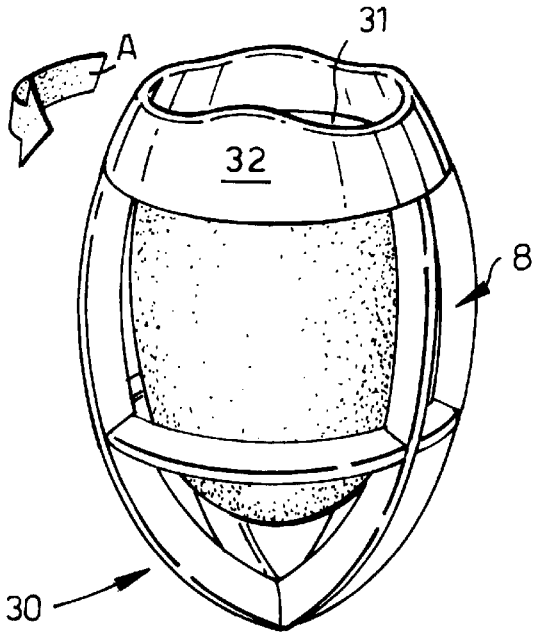
FIGS. 9 and 10 are perspective views of a device according to a further embodiment of the invention.
Figure 10:
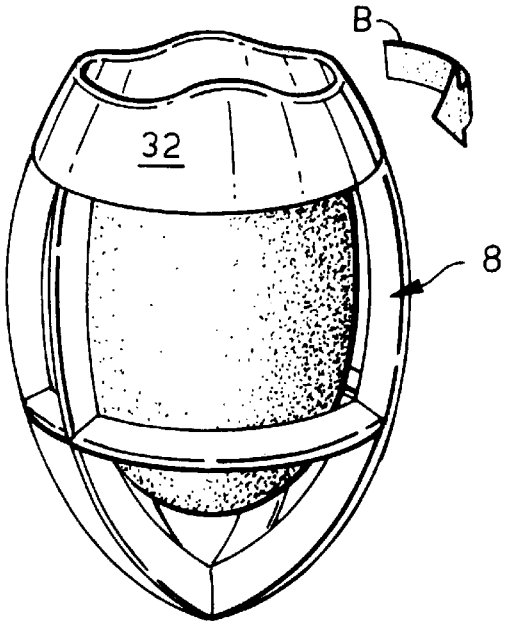
Figure 11:
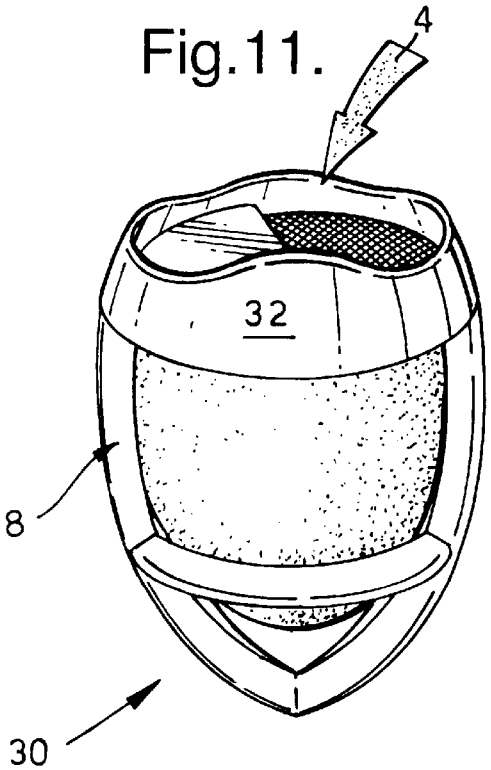
FIG. 11 is a perspective view of the device of FIGS. 9 and 10 in an open orientation

Referring to FIGS. 4 and 5 an alternative embodiment of the invention is described, in which parts similar to those described with reference to the previous embodiment are given the same reference numerals. In this embodiment, the device 20 includes a cage 21 which comprises three engaging circular rings 22, arranged about a common center point into a three dimensional structure having a mouth 23. Similarly to the previous embodiment, the mouth is dimensioned to engage with peripheral formations 11 of the rim 5 of the receptacle 2. The use of this embodiment is similar to that described with reference to the previous embodiment.

Referring to FIGS. 6 to 11, a further embodiment of the invention is described in which parts similar to those described with reference to the previous embodiments are assigned the same reference numerals. In this embodiment, the device 30 comprises a cage 8 which is substantially similar to that of FIGS. 1 to 3. The closing means comprises a two part assembly of a first element 31 which in use is fixedly connected to the rim 5 of the receptacle 2, which part covers portion of the opening, and a second part 32 which is mounted to the first part 31 for rotation thereon and includes a filling aperture 33. In use the device is filled by rotating the second part 32 in the direction of the arrow marked A until the filling aperture 33 coincides with an uncovered part of the filling opening thereby revealing the filling opening 4. Once the device has been filled with a desired amount of detergent product, the second part 32 is rotated in an opposite direction indicated by the arrow marked B in FIG. 10 thereby closing the opening 4.

Figure 12:
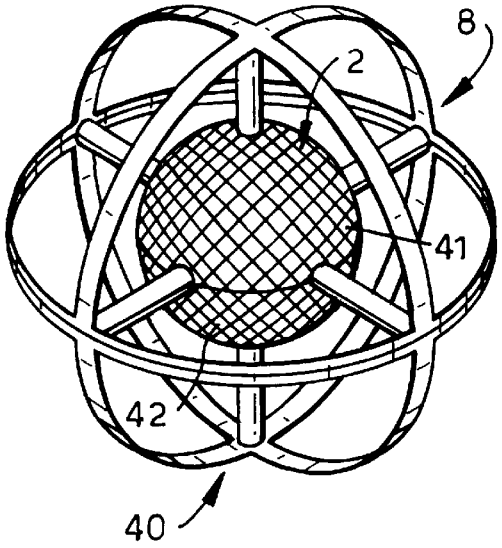
FIGS. 12 and 13 are view of a dispensing device according to a still further embodiment of the invention.
Figure 13:
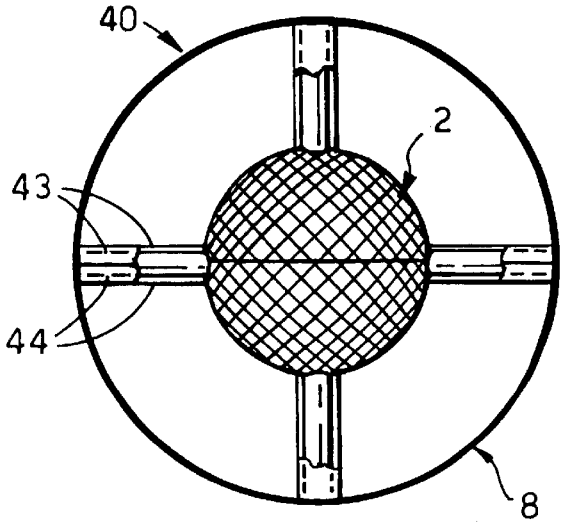
Figure 14:
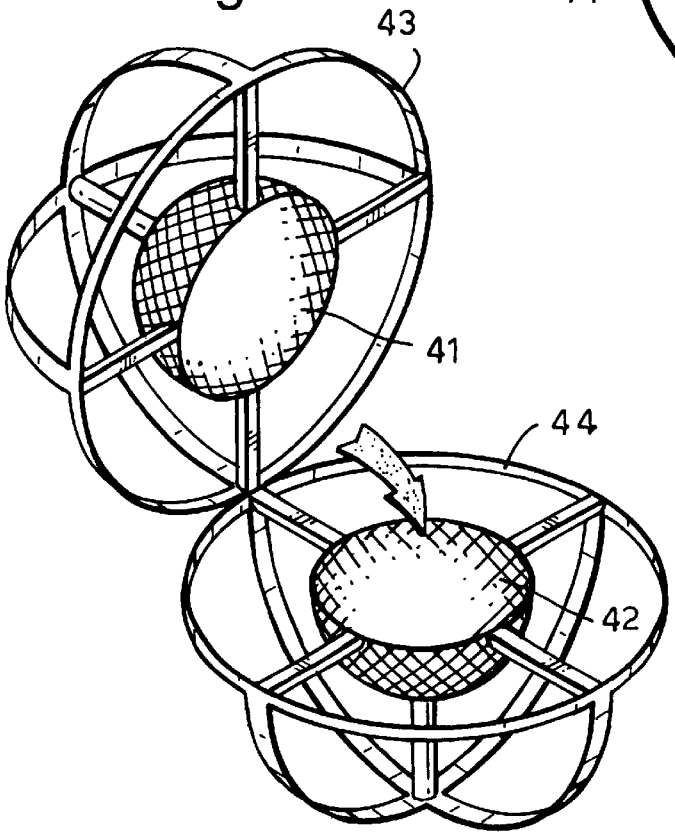
FIG. 14 is a perspective view of the device of FIGS. 12 and 13 in an open orientation.

Referring to FIGS. 12 to 14 a further embodiment of the invention is described having parts which are similar to those described with reference to the previous embodiments assigned the same reference numerals. In this embodiment the device 40 comprises a round receptacle 2 in two symmetrically opposed parts 41 and 42. Similarly the cage 9 comprises a round structure having two symmetrically opposed parts 43 and 44, which parts are hingedly connected together. Each part of the cage 43, 44 is connected to a part 41, 42 of the receptacle such that opening and closing of the cage 9 opens and closes the receptacle 2. In use the receptacle 2 is opened by opening the cage 9 about a hinge 45 and one of the receptacle parts 41, 42 is filled with a desired quantity of detergent product. The device 40 is then closed and used in a manner similar to those of the previous embodiments.

Figure 15:
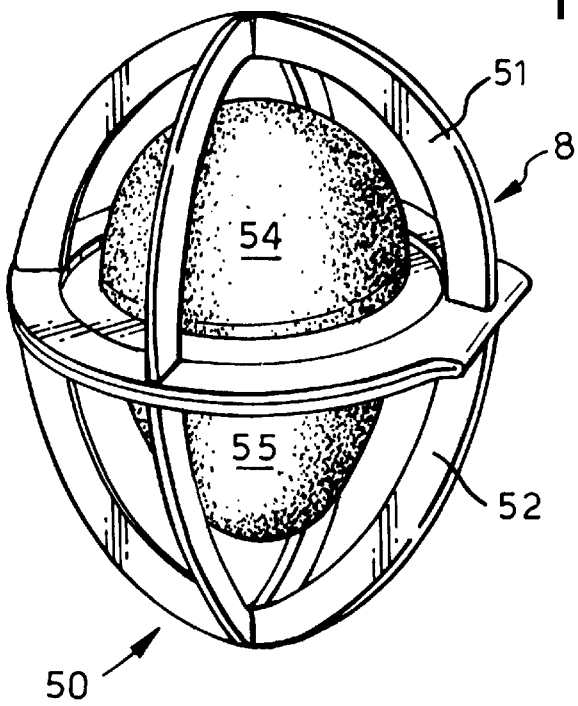
FIG. 15 is a perspective view of a further device according to the invention, with FIG. 16 showing the device in an open orientation.
Figure 16:
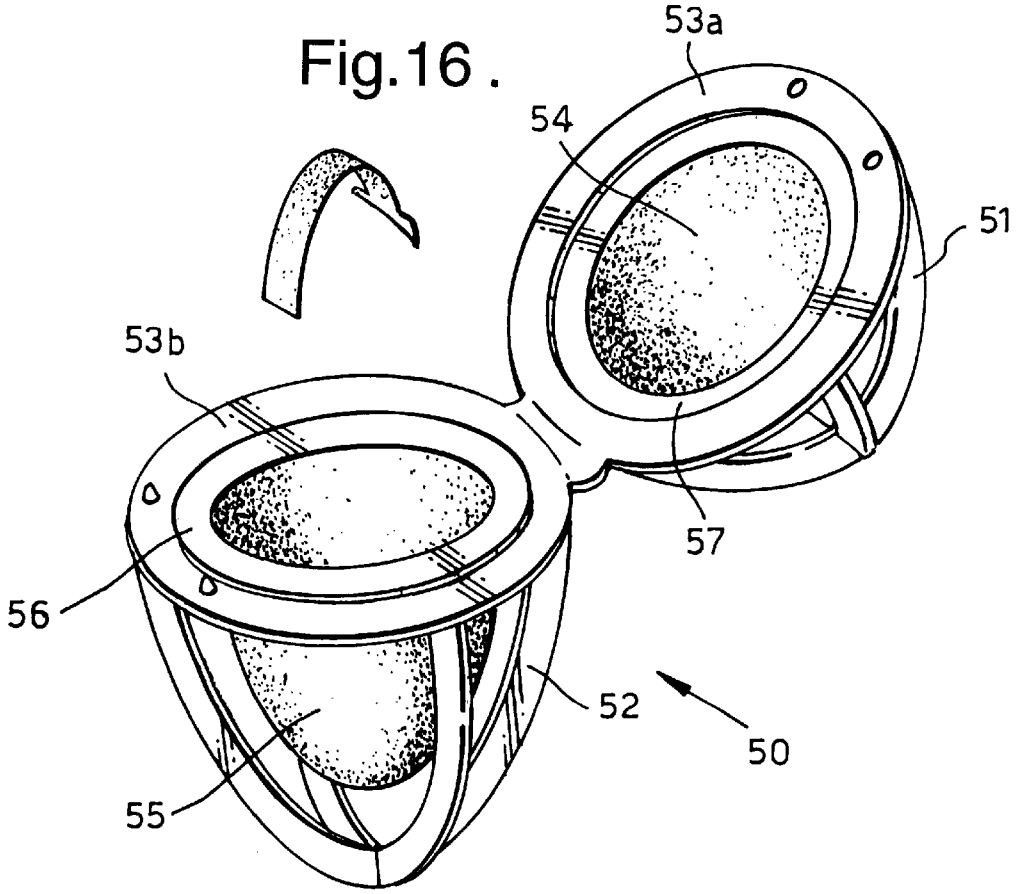

Referring to FIGS. 15 and 16 a still further embodiment of the invention is described in which parts similar to those described with reference to the previous embodiments are given the same reference numerals. In this embodiment, which on principals similar to the embodiment of FIGS. 12 to 14, the device 50 comprises a cage 8 in the form of an oval structure having two hingedly connected, symmetrically opposed parts 51 and 52 which on closing the two parts abut about common rim portions 53*a*, 53*b*. Similarly, the receptacle comprises an oval structure in two parts 54, 55, each part having an abutting rim portion 56, 57, each rim portion of the receptacle part being connected to a rim portion of the cage part, respectively. In this manner, opening and closing of the cage 9 effectively opens and closes the receptacle. The use of this embodiment is similar to that described with reference to the previous embodiment.

Figure 17:
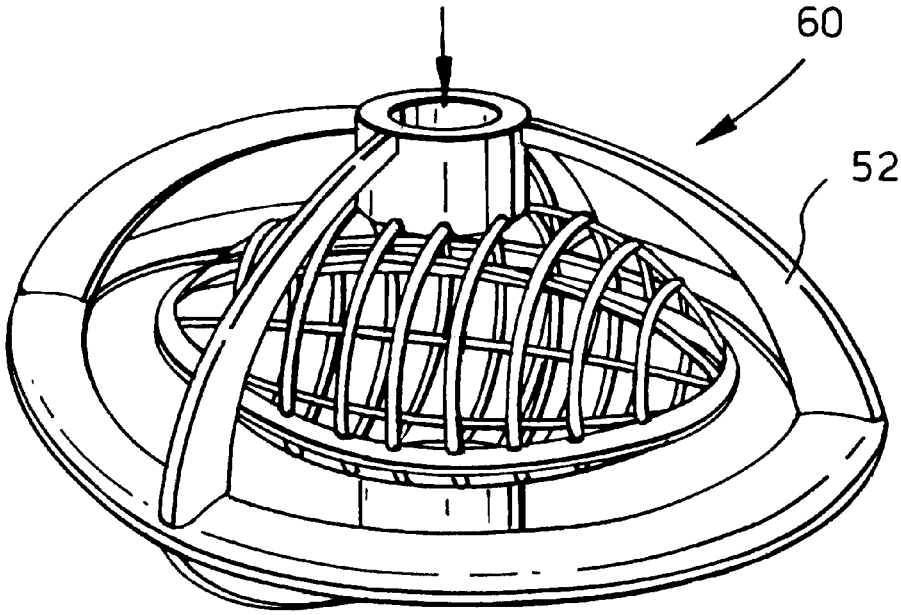
FIGS. 17 and 18 illustrate a further embodiment of the invention.
Figure 18:
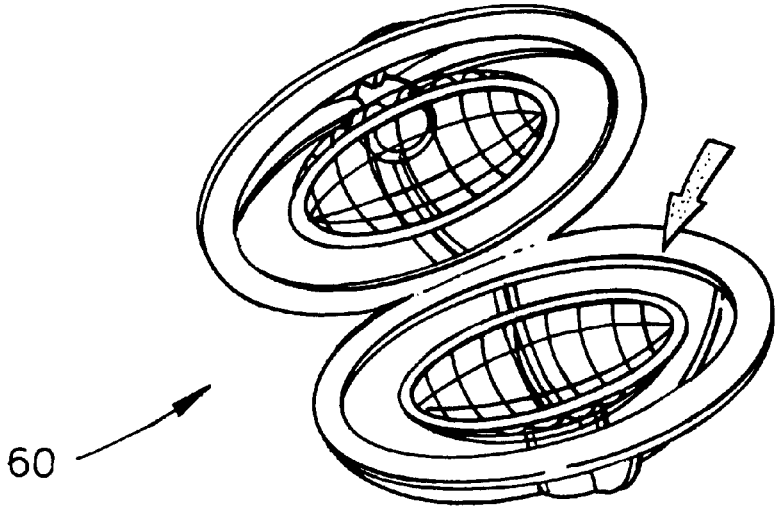

FIGS. 17 and 18 illustrate a device 60 which is similar in construction and operation to that of the previous embodiment.

Figure 19:
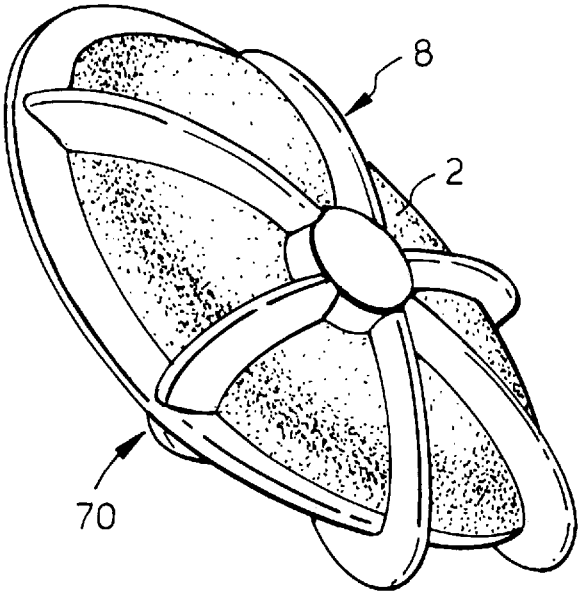
FIGS. 19 to 21 illustrate a still further embodiment of the invention.
Figure 20:
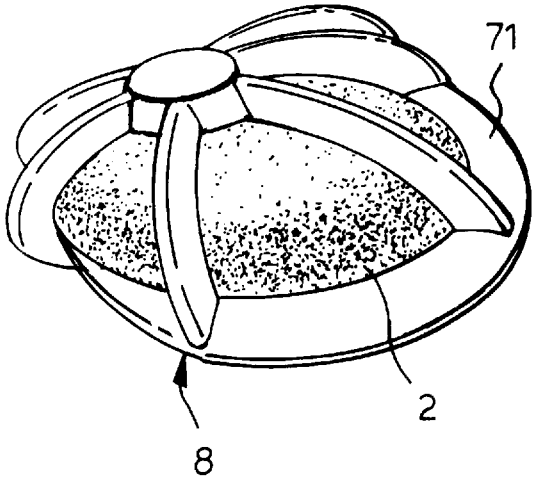
Figure 21:
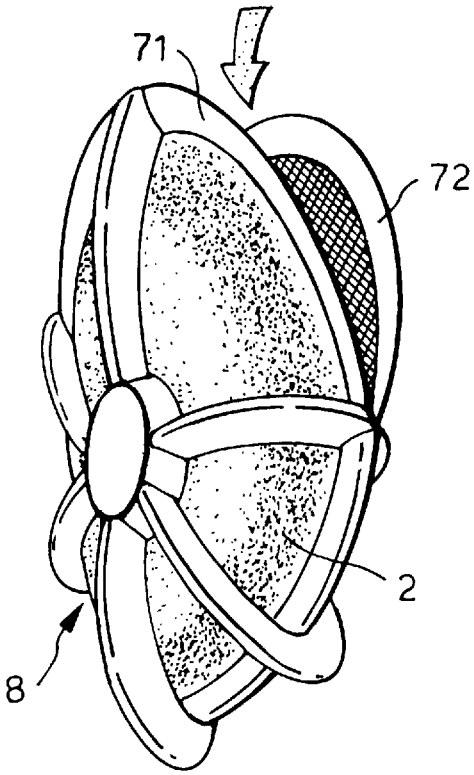

FIGS. 19 to 21 illustrates a further embodiment of the invention which is assigned the general reference 70 and which comprises a cage 8 generally in the form of a purse, and having a pair of opposed lip members 71 and 72 which are movable together and apart about common hinge portions (not shown) to open and close the device. In this embodiment the receptacle 2 is integrally formed inside the cage structure 8. The use of this embodiment is similar to that described with reference to the previous embodiments.

The invention is not limited to the embodiments hereinbefore described which may be varied in both construction and detail without departing from the spirit of the invention.

What is claimed is:

1. A dispensing device for the machine washing of laundry, comprising a receptacle for receiving an amount of a detergent product, the receptacle including a body wall having filling opening means and a plurality of apertures for dispensing the detergent product, wherein the device includes a rigid spacing means comprising a cage type structure interconnected to said receptacle, which is formed around the body wall for spacing laundry from the dispensing apertures wherein the receptacle is interconnected by engaging with the cage-type structure.

2. A dispensing device as claimed in claim 1 in which the body wall is perforated to allow penetration of a wash liquor into the receptacle.

3. A dispensing device as claimed in claim 2 in which the body wall comprises a mesh-type structure.

4. A dispensing device as claimed in claim 1 including closing means for the filling opening means.

5. A dispensing device as claimed in claim 4 in which the closing means comprises a removable plug.

6. A dispensing device as claimed in claim 1 in which the filling opening of the receptacle is defined by a peripheral rim, wherein the rigid spacing means extends from said rim.

7. A dispensing device as claimed in claim 6 in which the rigid spacing means comprises at least one spacing element which extends from one point on the rim, around the body wall, to a second point on the rim.

8. A dispensing device for the machine washing of laundry, comprising a receptacle for receiving an amount of a detergent product, the receptacle including a body wall having filling opening means and a plurality of apertures for dispensing the detergent product, wherein the device includes a rigid spacing means which is formed around the body wall for spacing laundry from the dispensing apertures, the dispensing device comprising two interconnecting parts, a first part comprising the receptacle in which the filling opening of the receptacle is defined by a peripheral rim, and a second part comprising the rigid spacing means, wherein the receptacle is inserted within a mouth of the spacing means, the rim of the receptacle engaging with the mouth of the spacing means.

9. A dispensing device as claimed in claim 8 in which the two interconnecting parts snap-fit together.

10. A dispensing device for the machine washing of laundry, comprising a receptacle for receiving an amount of a detergent product, the receptacle including a body wall having filling opening means and a plurality of apertures for dispensing the detergent product, wherein the device includes a rigid spacing means which is formed around the body wall for spacing laundry from the dispensing aperture, said receptacle comprising two hingedly connected parts which are movable together and apart to reveal the filling opening, wherein the rigid spacing means extends around each of the parts.

11. A dispensing device as claimed in claim 10 in which each part of the receptacle includes a peripheral rim which, on closing the two parts, abut, wherein the spacing means extends from each rim.

* * * * *